United States Patent [19]

Arabian

[11] 4,222,227

[45] Sep. 16, 1980

[54] CLOCK DIAL

[76] Inventor: Khachik Arabian, 700 Lincoln St., Worcester, Mass. 01605

[21] Appl. No.: 61,505

[22] Filed: Jul. 27, 1979

[51] Int. Cl.[3] ..... G04B 19/22; G04B 19/06

[52] U.S. Cl. ..... 368/27; 368/228

[58] Field of Search ..... 58/42.5, 43, 127 R

[56] References Cited

U.S. PATENT DOCUMENTS

| | | | |
|---|---|---|---|
| 125,073 | 3/1872 | Nieaaus | 58/43 |
| 369,462 | 9/1887 | Moyer | 58/43 |
| 1,046,246 | 12/1912 | Albrecht | 58/43 |
| 1,974,357 | 9/1934 | Eklund | 58/43 |
| 2,169,956 | 8/1939 | Leatart | 58/43 |
| 2,395,643 | 2/1946 | Ramsay | 58/43 |
| 2,535,543 | 12/1950 | Maizlish | 58/43 |

*Primary Examiner*—Vit W. Miska

*Attorney, Agent, or Firm*—Charles R. Fay

[57] ABSTRACT

A supplemental clock dial for a clock comprising an annular transparent disc mounted centrally on a bushing driven to turn the hour hand, an hour hand on the annular disc, said disc rotating once in twelve hours and including the names of countries or cities around the world and showing the time in those places, the names of said countries and cities being mounted on balanced swinging members so that they are always upright; and including separate members showing the AM and PM indications for each of said countries or cities these members being swingingly mounted on the first named members and including means to turn them 180° each twelve hours, and having weights for keeping the same in upright position for a period of twelve hours, whether AM or PM.

6 Claims, 3 Drawing Figures

CLOCK DIAL

BACKGROUND OF THE INVENTION

There is a need for a clock which will at a glance tell an observer the time in any important section of the world. This has been done using individual clocks, but that is expensive and wasteful.

As far as the applicant is aware these devices are cumbersome and expensive and often do not indicate the AM or the PM with regard to countries and cities around the globe, and it is the object of the present invention to provide a very simple clock dial which will indicate the times in various areas.

SUMMARY OF THE INVENTION

A conventional clock mechanism having a conventional clock face and a minute hand driven in the usual manner is overlain with a circular transparent dial mounted to turn by the hour mechanism. On the dial there is indicated an hour hand. A series of swiveling counterbalanced rosettes are located throughout the area of the circular dial but not obscuring the conventional clock face which is observable through the transparent over dial. The rosettes indicate various areas about the globe and are swiveled and balanced so that they are always erect and read horizontally. Each rosette is provided with a pivoted AM PM indicator (a smaller rosette) which is provided with a sliding weight to keep it erect. At the 12 O'clock position of the conventional clock they are engaged by pins which cause them to rotate 180° at the same time causing the weights to change from one position to another to hold the same as indicated until another 12 hours passes.

DISCUSSION OF THE PRIOR ART

Figure 1:
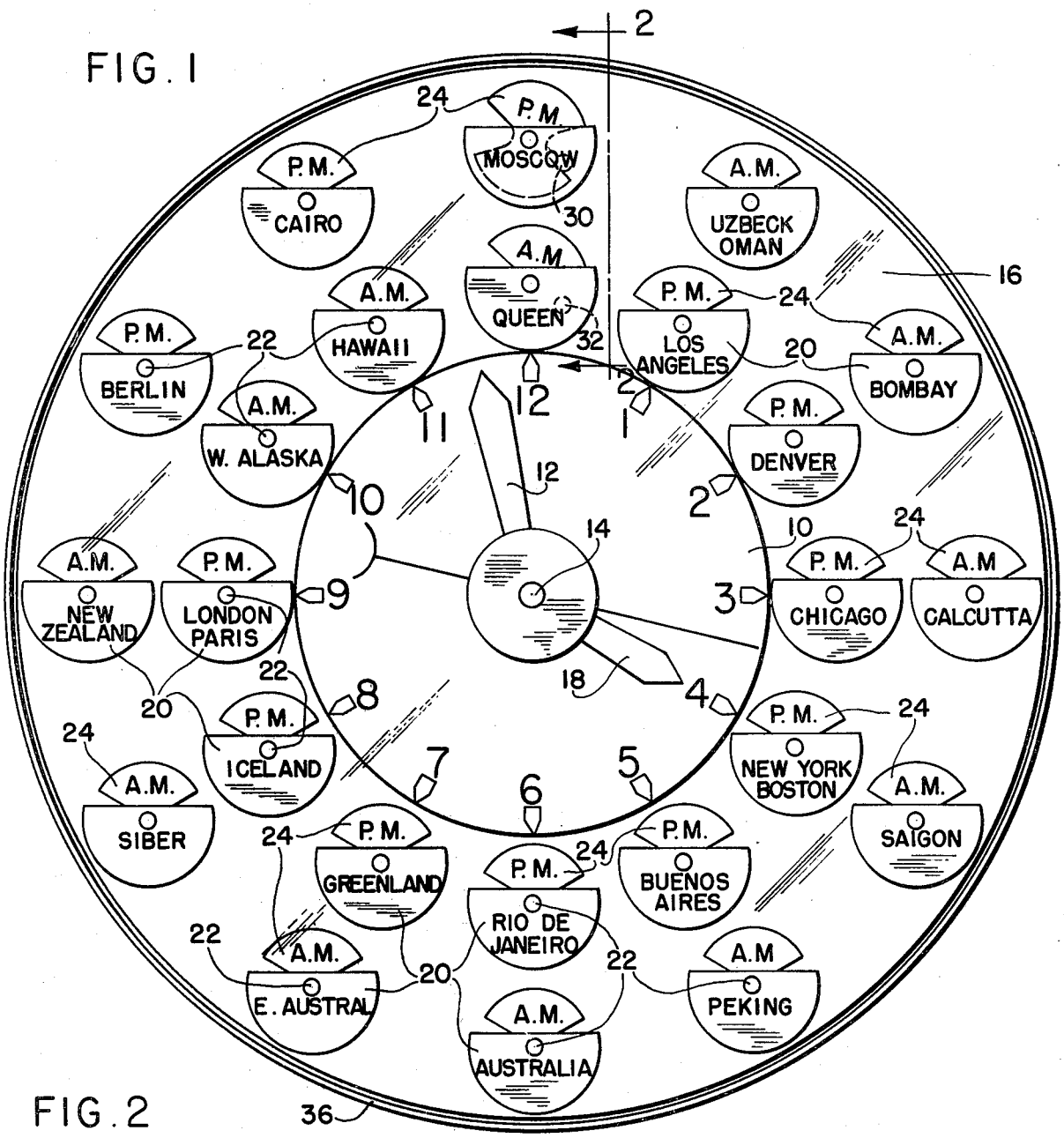
FIG. 1 is a view in front elevation.
Figure 2:
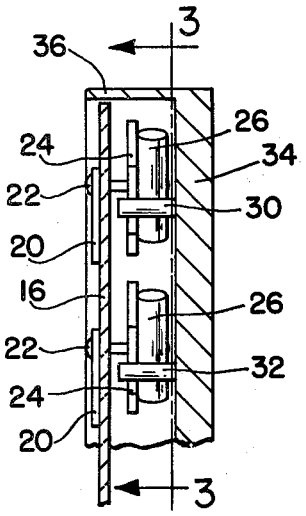
FIG. 2 is a section of line 2—2 of FIG. 1.

The following patents were noted as being most pertinent:

U.S. Pat. No. 125,073—a central block face with indicator dials around its circumference for time indication in various locations.

U.S. Pat. No. 369,462—a universal clock showing the longitudinal lines of the globe, its 24 hour time periods and the geographical location and time of the principal cities of the globe.

U.S. Pat. No. 1,046,246—a central clock face with indicator dials around its circumference which is geared from the center clock for indicating the time in each of the various locals.

U.S. Pat. No. 2,169,956—a world time indicator with AM and PM indications from the change in days.

U.S. Pat. No. 2,535,543—general interest which shows a timepiece with multiple dials indicating different geographical times.

PREFERRED EMBODIMENT OF THE INVENTION

A clock face of conventional appearance is indicated at 10 and it has a minute hand 12 driven in the usual manner and on the shaft or on the mechanism that drives the hand there is a pilot or spindle bushing 14 upon which is mounted a clear, transparent disc 16. It will be seen that the disc 16 overlies and extends beyond the entire clock face which is visible through it. The dial 16 is driven by the spindle bushing and rotates once in twelve hours. It has an hour hand 18 in fixed rotation thereon and this hour hand moves with the disc as do a series of rosettes 20,20. Each rosette is mounted to swing on a pivot pin 22, and these rosettes are weighted or counterbalanced in such a way that they always maintain the position as shown in the drawings in FIG. 1 regardless of the rotation of the disc 16.

On these rosettes there are indications as shown of different cities and countries, etc. and since the conventional clock face is fixed, the disc rotates (with the hour hand 18) indicating the hours consecutively in order and indicating the time in the respective cities or countries as indicated.

Therefore, it is seen that an observer is able to tell at a glance what time it is in any of the cities or countries which are indicated on the various rosettes 20, and these legends are always readable horizontally.

Figure 3:
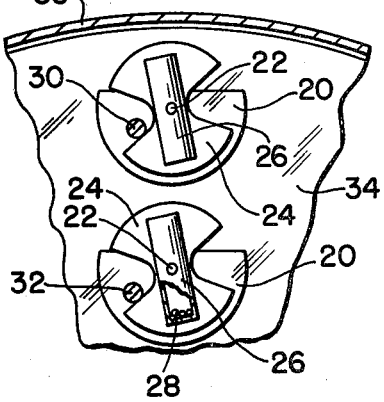
FIG. 3 is a section on line 3—3 of FIG. 2.

Smaller rosettes 24 are also mounted on the pins 22 and behind rosettes 20 to rotate on the pins. The rosettes 24 are of a kind of dumbbell shape, see FIG. 3, and as shown in FIG. 1 they indicate AM's and PM's so that the hour from one to twelve is indicated as to each city or country and also it is indicated as to whether it is AM or PM at the point and time.

The rosettes 24 are each provided with a tube 26 in which are movable weights 28 and at the twelve O'clock position there are two spaced studs 30 and 32 which engage the lower part of each rosette 24 at this time or position and rotates the same 180°. The rosettes 24 stay in this position due to sliding weights 28 for the next twelve hours or until one complete rotation is once more made.

A casing 34 with a protective rim 36 may encompass the entire disc 16 as well as the clock mechanism, etc.

I claim:

1. A clock comprising a conventional clock face, a minute hand, and means to drive an hour hand, a transparent disc greater in diameter than the clock face, mounted to be rotated by the hour hand driver means, a series of rosettes located on the disc with a central area of the disc covering the conventional clock dial unimcumbered, an hour hand on the disc, and geographical indicia on each rosette, said rosettes being swingably mounted and weighted to retain their indicia to be read in a horizontal condition, and a member for each rosette indicating in a selective relationship the AM or PM of the particular time at a particular location.

2. The clock of claim 1 wherein the AM PM members are swingable and including fixed means for rotating the same, each member having a PM in one portion and an AM on the other portion.

3. The clock of claim 2 wherein the rosettes and the AM PM members are mounted on the same axes.

4. The clock of claim 3 including movable overbalancing weights for each of the AM PM members to hold the latter where placed for twelve hours.

5. The clock of claim 4 wherein the AM PM members are each partly obscured by its rosette, so as to show only the AM or the PM.

6. The clock of claim 1 including means to power the driver means.

* * * * *